United States Patent [19]

Silber

[11] Patent Number: 4,744,688

[45] Date of Patent: May 17, 1988

[54] HAND TOOL FOR APPLYING HOT MELT ADHESIVE

[76] Inventor: David Silber, 1320 53rd St., Brooklyn, N.Y. 11219

[21] Appl. No.: 868,933

[22] Filed: May 30, 1986

[51] Int. Cl.[4] ..... B42C 9/00

[52] U.S. Cl. ..... 401/1; 401/21; 401/37; 401/2; 222/146.5; 219/230; 219/421; 156/579; 118/258

[58] Field of Search ..... 401/1, 2, 21, 22, 37; 222/146.5; 219/230, 421; 156/578, 579; 118/258, 259

[56] References Cited

U.S. PATENT DOCUMENTS

| | | | |
|---|---|---|---|
| Re. 27,828 | 12/1973 | Salonen | 222/146.5 |
| 1,352,122 | 9/1920 | Engel et al. | 401/21 |
| 1,965,753 | 7/1934 | Scoles | 118/258 |
| 2,523,860 | 9/1950 | Budden | 412/37 |
| 2,610,580 | 9/1952 | Burke | 401/21 |
| 2,898,618 | 8/1959 | Whitfield | 118/259 |
| 3,085,270 | 4/1963 | Vosbikian et al. | 401/22 |
| 3,762,365 | 10/1973 | Herzog | 118/259 |
| 3,875,368 | 4/1975 | Biewald | 219/230 |
| 3,950,105 | 4/1976 | Moss et al. | 401/1 |
| 4,065,214 | 12/1977 | Daum et al. | 402/2 |
| 4,196,028 | 4/1980 | Mills et al. | 156/579 |
| 4,334,793 | 6/1982 | Thompson | 401/1 |
| 4,376,008 | 3/1983 | Lauri et al. | 156/579 |
| 4,588,469 | 5/1986 | Hunter | 156/579 |

FOREIGN PATENT DOCUMENTS

| | | | |
|---|---|---|---|
| 76798 | 6/1976 | Australia | 156/579 |
| 50796 | 10/1935 | Denmark | 401/1 |
| 963307 | 12/1949 | France | 401/1 |
| 1078165 | 5/1954 | France | 401/1 |
| 2139654 | 1/1973 | France | 401/1 |
| 179792 | 3/1936 | Switzerland | 401/1 |
| 774399 | 5/1957 | United Kingdom | 401/21 |
| 947190 | 1/1964 | United Kingdom | 401/21 |

*Primary Examiner*—Gary L. Smith
*Assistant Examiner*—Eric K. Nicholson
*Attorney, Agent, or Firm*—Frishauf, Holtz, Goodman & Woodward

[57] ABSTRACT

A hand tool for applying hot melt adhesive which minimizes leakage and enhances the speed and convenience of adhering one material to another. An applicator roller receives liquefied adhesive through an adjacent slot in an upper part of a retention chamber. The slot is at the top level of the liquefied adhesive when the tool is in its rest position. On the outside of the chamber, and below it, a brayer roller is provided for pressing one material to another to complete the adhering process. The tool must be tilted forward to provide adhesive to the applicator roller while it is rolled across the material, and tilted back somewhat to lift the applicator roller and to press down on the material with only the brayer roller.

5 Claims, 3 Drawing Sheets

HAND TOOL FOR APPLYING HOT MELT ADHESIVE

BACKGROUND OF THE INVENTION

This invention is related to a hand tool for applying hot melt adhesive and, in particular, to such a tool which has its applicator roller positioned above the liquid level of the adhesive in the rest position of the tool so that leakage of the adhesive around the applicator roller due to gravity is prevented.

Hot melt adhesives are in popular use for conveniently attaching various items to each other. One example of such use occurs in the field of publishing in which a page layout of text and/or graphics is composed from many separate items carrying different pieces of information which are to be combined on a single page. In designing the layout of the page, small papers which carry portions of the layout are glued to a work surface. For purposes of the following discussion, the term "workpieces" designates the various pieces of paper which are to be attached to the work surface which, for example, can be a cardboard sheet. In some usages, the adhesive properties of the "glue" are sought to be as weak as possible so that the workpieces can be easily lifted without damage and placed somewhere else. A term of art for this type of adhesive might be a "wax". All the various types of adhesives are generally referred to herein by the term "hot melt adhesive".

In order to affix the workpieces to the work surface, each workpiece is first turned over so that its back is exposed, and an adhesive is then applied to it. The workpiece is then turned over again so that the text on it is visible. The workpiece is then placed on the work surface at the desired position. After the workpiece is placed on the work surface, a brayer cylinder is forcefully rolled ove the workpiece to firmly press it against the work surface in order to evenly distribute the adhesive and flatten out the workpiece.

One hot melt adhesive tool in common use is constructed of a housing with a handle extending horizontally backward therefrom. An applicator roller is rotatably attached to the bottom of the housing opposite a slot. The slot communicates a chamber in the housing with the roller. A heater is mounted inside the chamber which is large enough to accommodate several tablets or bars of solid adhesive which are melted by the heater when it is connected to a power source. A gasket between the housing and roller is provided in an effort to prevent leakage of the adhesive from the chamber, down along the applicator roller, and onto a rest surface when the tool is not in use. Leakage of the adhesive is likely because it is continuously kept in a liquid state by the heater carried inside the chamber, and the liquid lies directly atop the slot. It is desirable to keep the adhesive liquefied in order to enable instant use of the tool when required. Otherwise, time would have to be wasted in waiting for the adhesive to melt if the heater were only plugged in when its use was immediately required. However, although the above-mentioned gasket is provided to prevent such leakage, it functions unsatisfactorily. A tight seal between the applicator roller and gasket cannot be provided because it would require substantial pressure applied between the applicator roller and the gasket. Such pressure would, of course, hinder the free rolling action of the applicator. Therefore, although some pressure is applied between the roller and the gasket, it is not adequate to act as a liquid-tight seal. Also, with use and aging, the gasket tends to wear and/or shrink a bit, and this forms an additional route by which the adhesive can leak onto the rest surface. Thus, the fact that the applicator roller is in the direct path of the hot melt adhesive which is continuously attracted downward by gravity causes an inevitable leakage of adhesive and the resultant messiness, as well as the waste of adhesive.

A further disadvantage of the hand tools in current use is the requirement to use a separate tool as the brayer roller. Labor time is wasted in manually switching between the adhesive applicator and the brayer while affixing the workpieces to the work surface.

SUMMARY OF THE INVENTION

A primary object of the present invention is to provide a hand tool for applying hot melt adhesive which does not leak.

A further object of the invention is to provide such a hand tool which combines the brayer roller with the applicator roller in one body so that it is not necessary to manually alternate between two tools for performing these two operations.

Yet a further object of the invention is to provide such a hand tool which is sturdy, reliable, and relatively inexpensive.

Still a further object of the invention is to provide such a hand tool which is easy to use.

Another object of the invention is to provide such a hand tool which can be readily and conveniently assembled.

These and other objects of the invention are attained by a hand tool for applying a hot melt adhesive to a material to be adhered to a work surface, comprising: a housing containing a chamber and having a rest position and a use position, heater means in the housing for maintaining the hot melt adhesive in a liquefied state below a given level when the housing is in its rest position, a brayer roller rotatably secured to the housing, an applicator roller rotatably secured to the housing, a first opening in the housing adjacent the applicator roller and located at the given level, whereby the housing in its rest position rests on a support surface so that the applicator wheel is maximally displaced therefrom, and in its use position the housing is tilted so that at least one of the brayer and applicator rollers can contact the material.

DETAILED DESCRIPTION OF THE DRAWINGS

Figure 1:
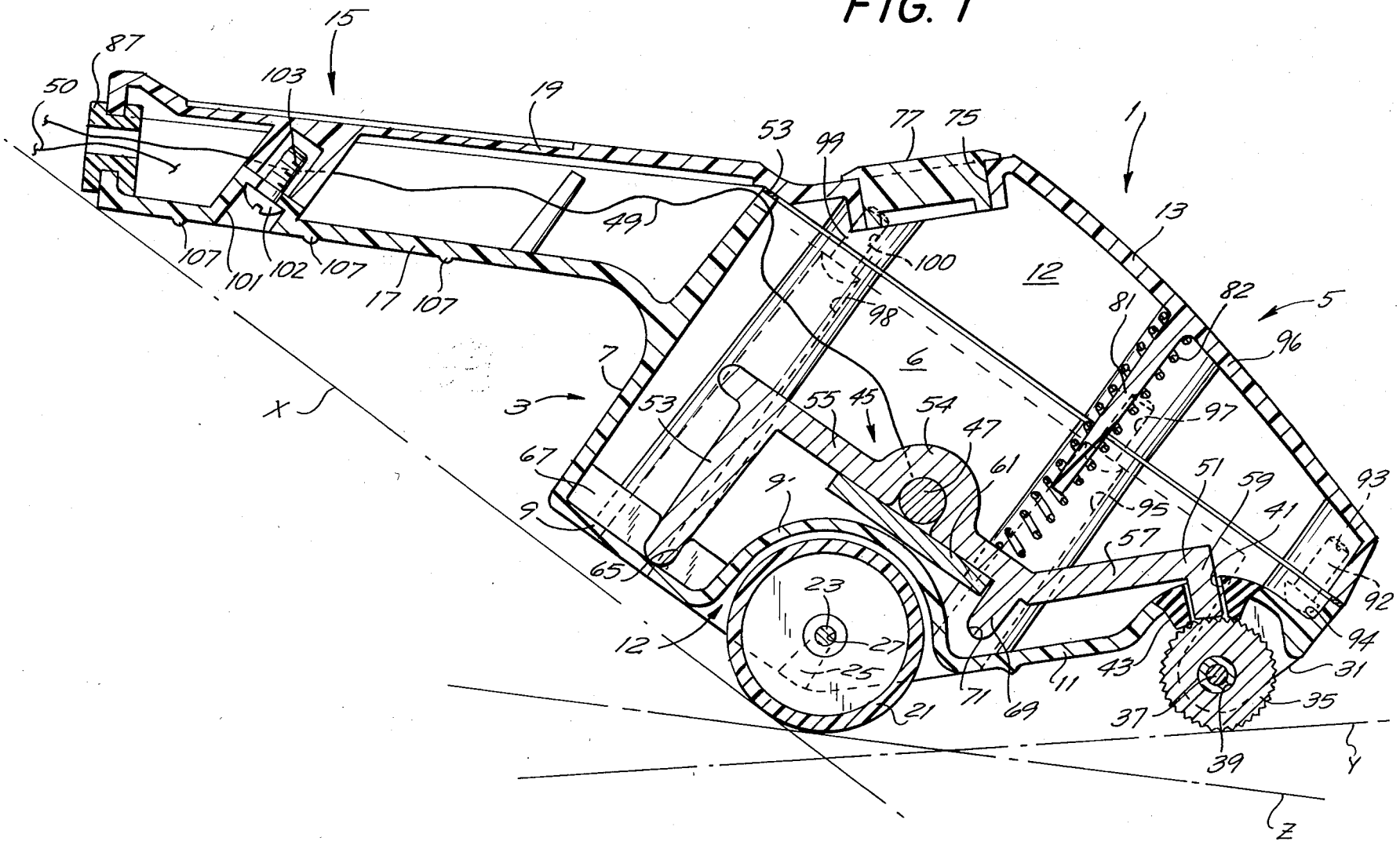
FIG. 1 is a cross-sectional view taken along line A—A′ in FIG. 2.
Figure 2:
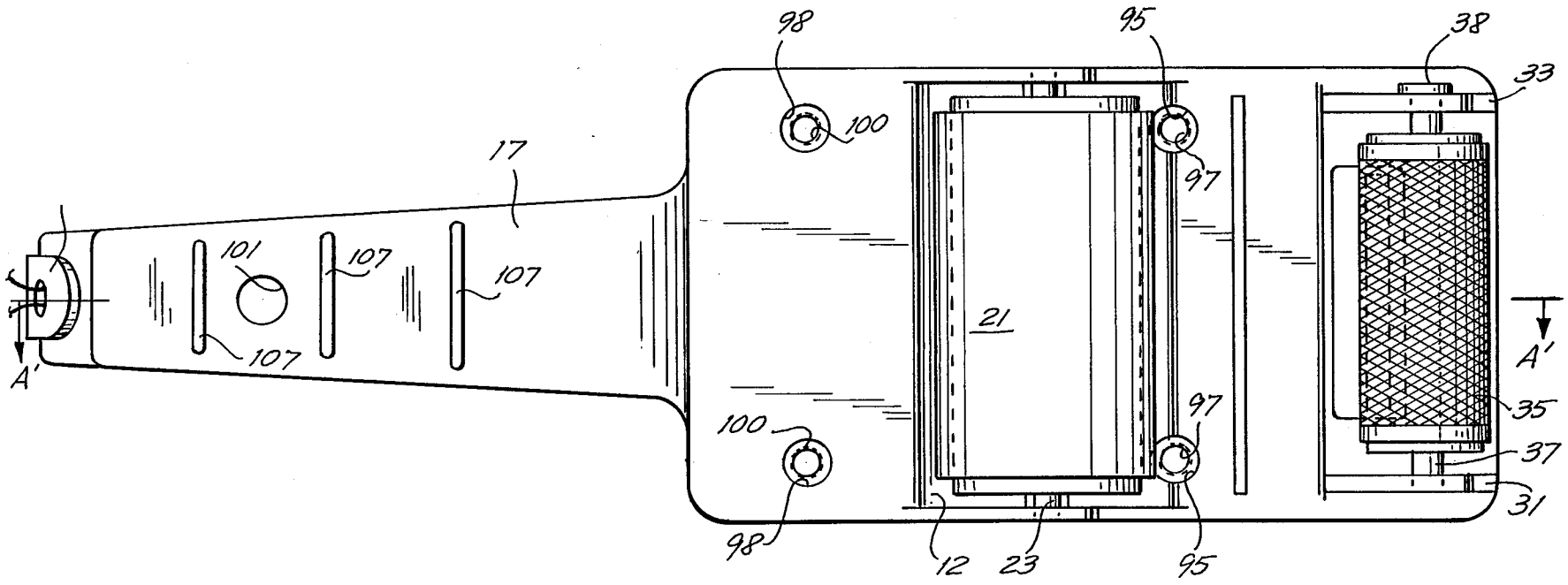
FIG. 2 is a bottom view of the invention.

FIG. 1 depicts hand tool 1 in relation to three straight reference lines. Viewing hand tool 1 from the perspective of reference line X shows it in its non-use, or rest, position. The immediately following discussion will be based on this reference line and the tool being in its rest position.

Hand tool 1 includes a housing comprised of lower body 3 and upper body 5. Lower body 3 includes a chamber 6 defined by rear wall 7, bottom wall 9, and front wall 11. Chamber 6 is further defined by top wall 13 of upper body 5. Side walls 8 and 10 of lower body 3 (see FIG. 3) and sidewalls 12 and its opposite wall (not shown) of upper body 5 complete the enclosure of chamber 6. Extending backward from rear wall 7 is handle 15. It includes a bottom portion 17 attached to rear wall 7 and a top portion 19 attached to top wall 13 of upper body 5.

Bottom wall 9 of lower body 3 includes a rounded cavity 12 formed in the shape of a wheel well. The cavity is bounded on the top by arced wall 9' and on the sides by sidewalls 8 and 10. The cavity accommodates within it most of a brayer roller 21. A portion of its periphery must, of course, extend outward of cavity 12 in order to expose some of its periphery to perform the task of rolling over the workpieces after they have been placed on the work surface following an application of adhesive. Extending laterally from cylinder 21 on each side thereof is a shaft 23 which is journalled into a corresponding recess in the walls 8 and 10, respectfully. The recess is accessed via a wall portion 25 best shown in FIG. 1. It is tapered inward to form a ramp. At the top of the ramp is recess 27 into which shaft 23 rotatably fits. Insertion of shaft 23 is accomplished by pressing it into cavity 12 against the opposing force of ramp 25 and, in the process, slightly deforming outwardly the walls 8 and 10. Once the shafts 23 are seated in recesses 27, the ramp forms a shoulder to prevent brayer 21 from accidentally falling out of the assembly. To remove the roller, walls 8 and 10 must be forcefully spread so that shaft 23 can be pulled out of cavity 12.

Curved wall portion 9' meets front wall 11 at brayer roller 21. Front wall 11 is advantageously inclined for reasons to be discussed below. Front wall 11 extends upward to meet top wall 13 of upper body 5. Toward the top of front wall 11, it is attached to two vertical sidewall extensions 31 and 33. These extend downward from the top portion of wall 11 where it meets side walls 8 and 10. Sidewall extensions 31 and 33 receive therebetween the applicator roller 35. A shaft 37 at either end of applicator roller 35 is journalled into recess 39 in each of the sidewall extensions. A sturdy, reliable coupling must be provided between applicator roller 35 and extensions 31, 33. Otherwise, roller 38 might fall out and the resultant leakage would produce a mess. The coupling of roller 35 to extensions 31, 33 is preferably made by way of a shaft 37. Shaft 37 extends through a center hole running the length of the roller 35 so that an end of shaft 37 is received in a recess in extension 33. A ring (not shown) secured to the tip of shaft 37 is snap fit securely into the recess. The other end of shaft 37 has a head 38 thereon bigger than the opening in extension 31. Head 38 can be grasped, as with pliers, to forcefully remove shaft 37. This approach is old and well known.

Facing applicator roller 35, an opening 41 is formed in front wall 11. This opening is in the shape of a slot aligned opposite roller 35 and through which the hot melt adhesive can flow to the applicator roller. The long dimension of opening 41 is parallel to the axis of roller 35. A gasket 43 is attached to front wall 11 and is positioned to press against applicator roller 35. Since gasket 43 completely surrounds the perimeter of slot 41 and also presses against roller 35, leakage of wax is prevented during application of the adhesive. Leakage of the adhesive in the rest position of the tool is also prevented, as discussed in further detail below.

Protruding through slot 41 is heater 45. Heater 45 includes a heating element 47 connected to a suitable power source by electrically conducting wires 49 and 50. A piece 51 made of suitable metal, such as copper or aluminum, is secured to heating element 47 and is accordingly heated thereby. The piece of metal 51 is shaped to include a leg 53, horizontal portion 55 which includes a hump 54 for accommodating heater element 47, an inclined portion 57 running parallel to front face 11, and an applicator-roller-engaging portion 59 which is inserted through slot 41 to touch applicator roller 35. The friction between portion 59 and roller 35 is negligible. A plate 61 is attached to the underside of horizontal section 55 of the heater in order to support heater element 47. Plate 61 can be attached to the heater body by any conventional means, such as riveting.

Figure 3:
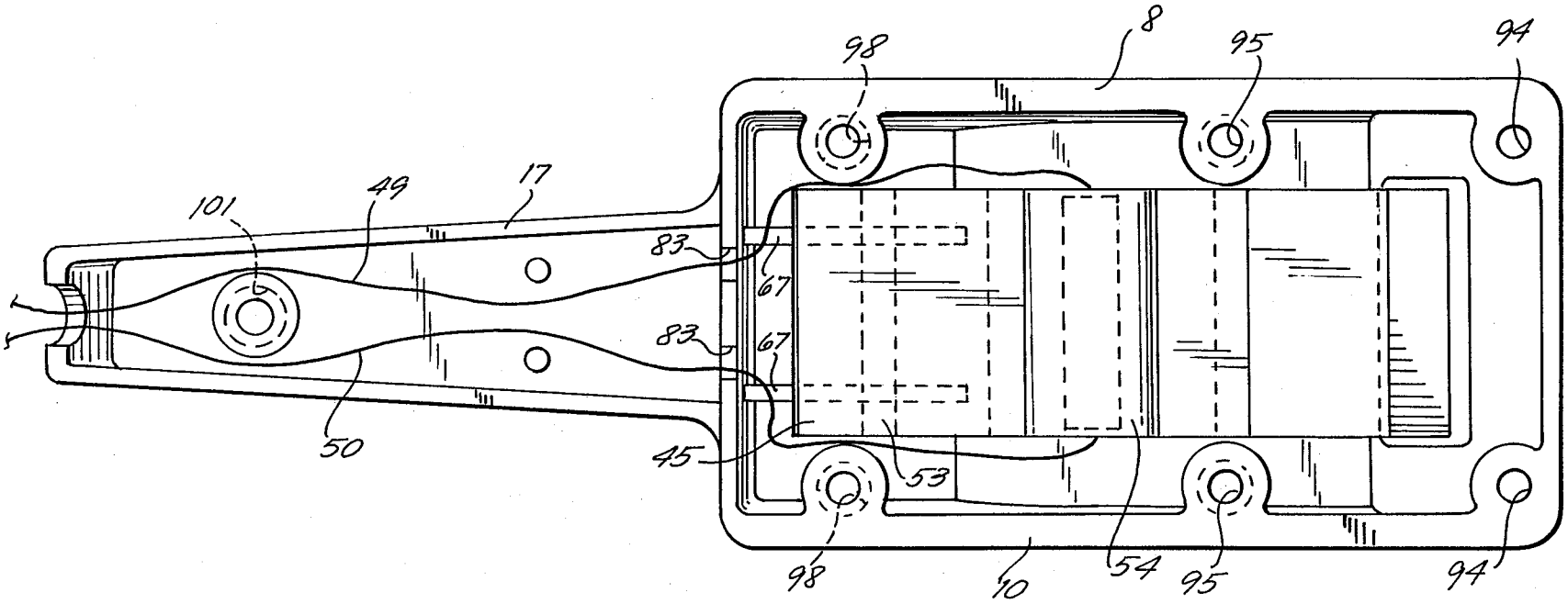
FIG. 3 is a plan view of the invention with the top removed for clarity of presentation.

Leg 53 of heater 45 sits in recess 65 in each of two bracing members 67 (best seen in FIG. 3). Bracing members 67 extend between and are connected to back wall 7 and arced portion 9' of bottom wall 9. The bottom of each bracing member is connected to bottom wall 9. Another leg 69 of heater 45 also sits in a recess 71 in a bracing member 73 which extends between side walls 8 and 10. Heater 45 can be attached to housing 3 by any conventional and well known means such as press fit or glue. Spring 82, discussed below, also secures the heater 45 in place.

It is important to place front extension 59 of heater 45 in contact with applicator roller 35. When the heater is connected to a power source, heat radiates from electrode 47 to front extension 59. By virtue of the contact between the applicator roller 35 and the heater 45, the applicator roller is also maintained in a heated condition. Application of the adhesive is assisted in that a heated applicator roller results in a smoother, more continuous flow of the adhesive onto the workpiece. Also, front extension 59 maintains the hot melt adhesive in slot 41 in a melted condition by virtue of its protrusion into and through the slot. Thus, the adhesive in that vicinity will not re-solidify while the tool is in its rest position so long as the heater is on.

Upper body 5 of housing 3 is a unitary piece which includes top wall 13 of chamber 6 as well as the top portion 19 of handle 15. An opening 75 is formed in wall 13. It tightly accommodates therein a cap 77 which can be securely inserted to close opening 75 when so desired. Opening 75 is sized to admit solid tablets or bars of the hot melt adhesive into chamber 6. It should be noted that wall 13 of upper body 5 is inclined upward to increase the space at the top of chamber 6. This provides added room to accommodate the solid adhesive tablets above heater 45. Opening 75 is inclined on a back portion of wall 13 so that insertion of the tablets exerts a force in the forward direction to move the tablets which are already in chamber 6 forward and away from the opening so as not to block it. Two spaced legs 81 extend downward from top wall 13. These are aligned above heater 45. Each one is accommodated within and guides the motion of a spring 82. Spring 82 is compressed between heater 45 and top wall 13 and acts to retain the heater in position.

Wires 49 and 50 run from electrode 47 through recesses 83 in back wall 7, and extend out to a power source (not shown) via the interior of handle 15 and tension relief gromet 87

Upper body 5 and lower body 3 of the tool are conveniently connected to each other with screws. Upwardly extending wells are provided in lower body 3 through which the screws can be inserted until they engage tapped holes in the upper body member. Specifically, six such wells are provided. A set of two screws 92 in the front of housing 1 are threaded into tapped holes 93 in upper body 13. The heads of screws 92 abut against a shoulder formed in a short well 94 in lower body 3. A set of two longer wells 95 accommodate screw 96 to pass therethrough until it is engaged in tapped hole 97 in upper body 5. A set of two still longer wells 98 is formed near rear wall 7 of lower body 3. It accommodates screws 99 which are threaded into tapped holes 100 in upper body 5. Finally, a recess 101 in bottom portion 17 of handle 15 accommodates screw 102 which is threaded into tapped hole 103 of top portion 19 in handle 15. The periphery of the upper and lower body portions of housing 1 match exactly so that a solid, smooth exterior is formed when the two bodies are connected to each other.

Handle 15 is angled downward relative to housing 3 in the tool rest position. This angle is advantageous for tilting the tool forward onto applicator roller 35 without having to tediously raise one's elbow and arm to any significant extent. Were the handle made horizontal, for example, the tilting angle required to bring the roller 34 down onto the workpiece would require too much effort to place the tool in the position necessary to apply the adhesive. This would be too laborious and tiresome for the user. Ribs 107 can be grasped by the fingers to further add to the convenience of using the tool.

The materials which constitute the preferred embodiment of the tool include aluminum for the applicator roller and heater. The brayer roller can be made of nylon. The housing is constructed also of nylon. The gromet is a resilient material such as rubber while the gasket is preferably a silicon rubber covered by Mylar.

The upper and lower body members are preferably molded in a unitary body of a nylon material. Bottom portion 17 of handle 19 is also formed as a unitary part of the bottom member 3 while top portion 19 is formed as a unitary part of upper body 3. Heater 45 is shaped by conventional means to the desired form as depicted in the drawings and a discussed above. Electrode 47 is attached to wires 49 and 50 and secured by plate 61 into the arced portion of heater 45. The heater is then slipped into chamber 46 and suitably secured as described above. Upper body 5 is then lowered onto lower body 3 and the various screws are used to firmly attach one to the other. Brayer roller 21 is then forcefully inserted into the wheel well at the bottom of housing 3 by spreading side walls 8 and 10 as shaft 23 engages tapered wedge 25 on the inside of the side walls. At the top of the wedge, shaft 23 snaps into holes 27. Likewise applicator roller 35 is inserted between sidewall extensions 31 and 33 and shaft 37 secures it rotatably in place. In this position, applicator roller 35 is pressed against gasket 43 and is also in contact with front extension 59 of heater 45.

In operation, adhesive tablets or bars (not shown) are inserted into chamber 6 through opening 75 in top wall 13 of the housing. These fill up the chamber 6 above heater 45. When heater 45 is connected to a source of power, it will melt all the adhesive tablets in its vicinity. Liquefied adhesive will flow off the horizontal heater surfaces leaving room at the upper reaches of chamber 6 for the insertion of more tablets. A fluid level will be established which reaches approximately to the height of slot 41 when the tool is in its rest position relative to reference line X shown in FIG. 1. With this configuration of the invention, the liquefied adhesive does not constantly sit atop an opening through which it is attracted by gravity. Leakage, in the prior art, is prevented only with use of the "seal" between the applicator roller and a gasket. With the configuration of the invention, however, the liquefied adhesive is not exposed to such leakage-producing conditions. Instead, its liquefied level can be just below slot 41 so that when the tool is in its rest position, it is impossible for any adhesive to reach slot 41. Moreover, even if a higher level of liquefied adhesive occurs, it does not lie directly atop the opening. Some of the force exerted by gravity downwardly on the adhesive is taken up by the side walls of the slot. Thus, the adhesive must flow sideways rather than downward in order to leak. As can readily be seen, this is a condition much less likely than the prior art configuration to result in leakage.

In use, the tool is tilted to a position depicted in FIG. 1 relative to reference line Y. In this position, applicator roller 35 is in contact with the work surface while brayer roller 21 is spaced somewhat above it. Construction of wall 11 in a tilted state is now readily seen to be highly advantageous because no corner exists to interfere with the positioning of roller 35 onto the work surface. With the tool being tilted forward, adhesive rushes to the front of chamber 6 and collects above opening 41. Slot 41 is now filled with adhesive which, as applicator roller 35 turns, is picked up by the applicator roller and applied to the workpiece. Upon completion of the adhesive application step, the workpiece is turned over and placed onto the work surface. The tool is then slightly tilted backward as shown in reference to line Z. In this position, the brayer roller 21 contacts the workpiece and applicator roller 35 is lifted somewhat above the work surface. A back and forth motion of brayer roller 21 normally suffices to complete the adhesion of the workpiece onto the work surface.

As is apparent from the above, one tool advantageously incorporates the two elements of an applicator roller and a brayer roller required to complete the placement of a workpiece on a work surface. In addition, the likelihood of leakage is sharply diminished by configuring the housing so that the applicator roller is not placed in the path of the downwardly attracted liquefied adhesive. By suitably inclining the front wall and handle of the housing, the convenience of using this tool is enhanced so that a slight tilt forward of the tool is all that is required to place either the brayer roller or the applicator roller onto the workpiece.

While a preferred embodiment of the invention has been described in detail above, various changes and modifications will be readily apparent. For example, various means can be utilized to rotatably connect the brayer roller and applicator roller to the housing. The shaft could extend through the side wall and nuts can be attached on the outside of the side walls to maintain the rollers in place. These and other such modifications are intended to fall within the scope of the invention as defined by the following claims.

I claim:

1. A hand tool for applying a hot melt adhesive to a material to be adhered to a work surface, comprising:

a housing containing a chamber adapted for retaining a selected amount of hot melt adhesive, said housing having a rest position and a use position;

heater means in said housing for maintaining the hot melt adhesive in a liquefied state;

a brayer roller rotatably secured to said housing;

an applicator roller rotatably secured to said housing, said heater means including a portion in sliding engagement with said applicator roller;

a first opening in said housing adjacent said applicator roller in communication with said chamber;

whereby said housing in its rest position is adapted to rest on a horizontal support surface with the applicator roller being vertically displaced therefrom and said first opening communicating with said chamber at a point substantially above the chamber bottom, and in its use position the housing is tilted for the liquefied hot melt adhesive to flow toward said point and enter the first opening and so that at least one of the brayer and applicator rollers contacts said material.

2. The hand tool of claim 1, wherein a gasket is attached along the periphery of said first opening and is in slidable contact with said applicator roller.

3. The hand tool of claim 2, wherein a handle is attached to the rear wall of said housing.

4. The hand tool of claim 3, wherein the top of said housing is detachable.

5. The hand tool of claim 4, wherein the top of said housing includes a second opening sized to pass solid tablets of said hot melt adhesive.

* * * * *